US008950227B2

(12) United States Patent
Hohenbichler et al.

(10) Patent No.: US 8,950,227 B2
(45) Date of Patent: Feb. 10, 2015

(54) METHOD AND DEVICE FOR PREPARING HOT-ROLLING STOCK

(75) Inventors: Gerald Hohenbichler, Kronstorf (AT); Reinhard Karl, Leonding (AT)

(73) Assignee: Siemens Vai Metals Technologies GmbH (AT)

( * ) Notice: Subject to any disclaimer, the term of this patent is extended or adjusted under 35 U.S.C. 154(b) by 621 days.

(21) Appl. No.: 13/263,901

(22) PCT Filed: Mar. 22, 2010

(86) PCT No.: PCT/EP2010/053680

§ 371 (c)(1),
(2), (4) Date: Dec. 8, 2011

(87) PCT Pub. No.: WO2010/115698

PCT Pub. Date: Oct. 14, 2010

(65) Prior Publication Data

US 2012/0067095 A1 Mar. 22, 2012

(30) Foreign Application Priority Data

Apr. 9, 2009 (AT) ..... A564/2009

(51) Int. Cl.
*B21B 37/74* (2006.01)
*B21B 45/04* (2006.01)
(Continued)

(52) U.S. Cl.
CPC ..... *B21B 37/74* (2013.01); *B21C 43/00* (2013.01); *B21B 15/005* (2013.01); *B21B 38/00* (2013.01); *B21B 38/006* (2013.01); *B21B 45/004* (2013.01); *B21B 45/06* (2013.01); *B21B 45/08* (2013.01)
USPC ..... 72/12.2; 72/200; 72/40

(58) Field of Classification Search
CPC .... B21B 45/04; B21B 45/06; B21B 2261/20; B21B 2261/21
USPC ..... 72/8.5, 11.3, 12.2, 18.3, 19.1, 39, 40, 72/200, 202; 29/33 C, 527.7
See application file for complete search history.

(56) References Cited

U.S. PATENT DOCUMENTS 5,542,165 A 8/1996 Coassin et al. ..... 29/33 C
5,634,257 A 6/1997 Kajiwara et al. ..... 29/527.7
(Continued)

FOREIGN PATENT DOCUMENTS

AT 409464 B 8/2002
CN 1116136 A 2/1996 ..... B21B 1/00
(Continued)

OTHER PUBLICATIONS

Chinese Office Action, Application No. 201080015748.9, 16 pages, May 2, 2013.
(Continued)

*Primary Examiner* — Debra Sullivan
(74) *Attorney, Agent, or Firm* — Ostrolenk Faber LLP

(57) ABSTRACT

A method and a device have high energy efficiency and high descaling performance, with which high-quality rolling stock can be produced. In a method in which the rolling stock is heated in an induction furnace and subsequently descaled, before the rolling stock is rolled in a rolling stand or rolling relay, the heated rolling stock is descaled by at least one rotating water jet from a rotary descaler; then at least one temperature of the descaled rolling stock is respectively recorded by a temperature measuring instrument and delivered to a controller; and the controller determines at least one control parameter with the aid of a control rule and by taking into account a setpoint temperature, and delivers it to a control component, at least one inductor of the induction furnace being driven so that the temperature of the descaled rolling stock corresponds as far as possible to the setpoint temperature.

19 Claims, 3 Drawing Sheets

(51) Int. Cl.

| | |
|---|---|
| ***B21C 43/00*** | (2006.01) |
| *B21B 15/00* | (2006.01) |
| *B21B 38/00* | (2006.01) |
| *B21B 45/00* | (2006.01) |
| *B21B 45/06* | (2006.01) |
| *B21B 45/08* | (2006.01) |

(56) References Cited

U.S. PATENT DOCUMENTS

| | | | | |
|---|---|---|---|---|
| 5,697,241 | A * | 12/1997 | Djumlija et al. | 72/39 |
| 6,092,586 | A | 7/2000 | Schonbeck et al. | 164/476 |
| 6,149,733 | A | 11/2000 | Djumlija et al. | 134/32 |
| 6,389,666 | B1 | 5/2002 | Grothe | 21/81.08 |
| 7,181,943 | B2 | 2/2007 | Seidel | 72/39 |
| 7,357,011 | B2 | 4/2008 | Rittner et al. | 72/200 |
| 8,145,346 | B2 | 3/2012 | Kurz et al. | 700/150 |
| 2008/0276679 | A1 | 11/2008 | Eckerstorfer et al. | 72/38 |
| 2012/0067095 | A1 | 3/2012 | Hohenbichler et al. | 72/11.3 |

FOREIGN PATENT DOCUMENTS

| | | | | |
|---|---|---|---|---|
| CN | 1214642 | A | 4/1999 | B21N 1/00 |
| CN | 1260253 | A | 7/2000 | B21B 45/00 |
| CN | 1310648 | A | 8/2001 | B21B 1/46 |
| DE | 19518144 | A1 | 11/1995 | B21B 1/26 |
| DE | 19613718 | C1 | 10/1997 | B21B 1/46 |
| DE | 69408595 | T2 | 10/1998 | B21B 1/46 |
| DE | 102004040927 | A1 | 3/2006 | B21C 43/00 |
| EP | 0860215 | A1 | 8/1998 | B21B 1/46 |
| JP | 1-205810 | | 8/1989 | |
| JP | 3-294017 | | 12/1991 | |
| JP | 10-230313 | | 9/1998 | |
| JP | 11-156426 | | 6/1999 | |
| JP | 2000-176526 | | 6/2000 | |
| JP | 2001-300627 | | 10/2001 | |
| JP | 2004136291 | A | 5/2004 | B21B 37/00 |
| JP | 2004-283846 | | 10/2004 | |
| JP | 2005-000935 | | 1/2005 | |
| JP | 2005177781 | A | 7/2005 | B21B 1/26 |
| JP | 2005270982 | A | 10/2005 | B21B 37/00 |
| JP | 2009076922 | A * | 4/2009 | |
| KR | 10-1999-0082108 | | 11/1999 | |
| KR | 2005-0009463 | A | 1/2005 | |
| RU | 2 089 307 | C1 | 9/1997 | |
| RU | 2 128 559 | C1 | 4/1999 | |
| RU | 2 146 974 | C1 | 3/2000 | |
| WO | 97/27955 | A1 | 8/1997 | B21B 45/08 |
| WO | 02/070157 | A1 | 9/2002 | B21B 45/08 |
| WO | 2007/054237 | A1 | 5/2007 | B21B 1/46 |
| WO | 2007/087886 | A1 | 8/2007 | B22D 11/12 |
| WO | 2008/043684 | A1 | 4/2008 | B21B 37/00 |
| WO | 2010/115698 | A1 | 10/2010 | B21B 37/74 |

OTHER PUBLICATIONS

International PCT Search Report and Written Opinion, PCT/EP2010/053680, 9 pages, Jul. 21, 2010.

Office Action dated Oct. 31, 2014 issued in corresponding Korean Patent Application No. 10-2011-7026458.

* cited by examiner

METHOD AND DEVICE FOR PREPARING HOT-ROLLING STOCK

CROSS-REFERENCE TO RELATED APPLICATIONS

This application is a U.S. National Stage Application of International Application No. PCT/EP2010/053680 filed Mar. 22, 2010, which designates the United States of America, and claims priority to Austrian Patent No. A564/2009 filed Apr. 9, 2009, the contents of which are hereby incorporated by reference in their entirety.

TECHNICAL FIELD

The present invention relates to a method and a device for preparing hot-rolling stock before shaping in at least one rolling stand or rolling relay.

Specifically, the invention relates to a method for preparing hot-rolling stock before shaping in at least one rolling stand or rolling relay, which comprises the following steps heating the rolling stock in an induction furnace;

descaling the heated rolling stock;

rolling the descaled rolling stock in a rolling stand or a rolling relay.

Devices for carrying out the method for preparing rolling stock before shaping in at least one rolling stand or rolling relay essentially comprise an induction furnace, followed by a descaler and at least one rolling stand or rolling relay.

BACKGROUND

In a combined casting and rolling plant, it is known from the unpublished Austrian Patent Application A533/2008 to heat a hot-rolling stock in an induction furnace and subsequently descale the heated rolling stock in a descaling device, before shaping is carried out in a rolling relay. Although the induction furnace provides energy-efficient heating with a high yield of the hot-rolling stock, the rolling stock is strongly cooled by the descaling of the rolling stock by means of a conventional descaler, so that the rolling stock enters the rolling relay with a significantly reduced temperature compared with the exit temperature after the induction furnace, as a result of which the energy efficiency of the production method and the quality of the rolled product are detrimentally affected.

It is known from Patent Application WO97/27955 A1 to descale a hot-rolling stock by means of a rotary descaler, so that a low water consumption and less cooling for the same descaling performance of the rolling stock can be achieved than with conventional descaling devices.

SUMMARY

According to various embodiments, a method and device for preparing hot-rolling stock before shaping in a rolling stand or rolling relay can be provided, which have a high energy efficiency and a high descaling performance, the associated device having compact dimensions. By using the method according to various embodiments, it should furthermore be possible to produce rolling stock with uniformly high quality.

According to various embodiments, a method for preparing hot-rolling stock, may comprise the steps of—heating a rolling stock in an induction furnace;—descaling the heated rolling stock;—rolling the descaled rolling stock in a rolling stand or a rolling relay, wherein—the heated rolling stock is descaled by at least one rotating water jet from a rotor of a rotary descaler;—at least one temperature of the descaled rolling stock is respectively recorded by means of a temperature measuring instrument and delivered to a controller; and wherein—in that the controller determines at least one control parameter with the aid of a control rule and by taking into account a setpoint temperature, and delivers it to a control component, at least one inductor of the induction furnace being driven so that the temperature of the descaled rolling stock corresponds as far as possible to the setpoint temperature.

According to a further embodiment, a temperature profile of the descaled rolling stock can be recorded by means of a temperature profile measuring instrument and delivered to a controller, and in that the controller determines a plurality of control parameters with the aid of a control rule and by taking into account a setpoint temperature profile and delivers them to a plurality of control components, a plurality of inductors of the induction furnace being driven so that the temperature profile of the descaled rolling stock corresponds as far as possible to the setpoint temperature profile. According to a further embodiment, the rolling stock can be heated in the induction furnace by means of at least one inductor with longitudinal field or transverse field heating, the inductor being driven as a function of the control parameter with variable power and optionally variable frequency. According to a further embodiment, the heating of the rolling stock in the induction furnace can be carried out for—a rolling stock thickness<6 mm: preferably by transverse field heating;—12 mm>rolling stock thickness>6 mm: by at least one inductor each with transverse field and longitudinal field heating;—a rolling stock thickness>12 mm: preferably by longitudinal field heating. According to a further embodiment, the water jet applied to the rolling stock may act on the rolling stock in an interrupted fashion. According to a further embodiment, the water jet can be generated by at least one rotor having respectively one, preferably from 4 to 12, rotating nozzles, the water delivered to the rotor having a pressure of from 100 to 450 bar, preferably from 250 to 420 bar. According to a further embodiment, the thickness of a scale layer of the heated rolling stock can be determined by means of a scale thickness detector and, as a function thereof, either—the pressure of the water delivered to the rotor; or—the rotational speed of the rotor is adjusted in a controlled or regulated way. According to a further embodiment, the scale layer of the heated rolling stock can be cooled significantly by water jets from a precooler.

According to another embodiments, a device for preparing hot-rolling stock before shaping in at least one rolling stand or rolling relay, may comprise an induction furnace, followed by a descaler and at least one rolling stand, wherein—the descaler is configured as a rotary descaler and comprises at least one rotor respectively having at least one rotating nozzle to which water can be applied;—in that a temperature measuring instrument for measuring the temperature of the rolling stock is arranged before a first rolling stand; and—in that the device comprises a control instrument for controlling the temperature of the rolling stock, the control instrument being connected to the temperature measuring instrument and at least one inductor of the induction furnace.

According to a further embodiment, the temperature measuring instrument can be configured as a temperature profile measuring instrument, it being in communication with at least one control instrument. According to a further embodiment, the induction furnace may comprise either exclusively inductors with longitudinal field or transverse field heating, or at least one inductor each with longitudinal field and transverse field heating. According to a further embodiment, the at least one rotor may have a vertical rotation axis and can be removed in the horizontal direction from the rotary descaler. According to a further embodiment, a rotor respectively may contain an interrupter for generating an interrupted water jet. According to a further embodiment, a rotor respectively may comprise from 4 to 12 rotating nozzles. According to a further embodiment, arranged downstream of the induction furnace, there can be a scale thickness detector which is in communication with either—a pressure control instrument for adjusting the water applied to the rotor; or—a rotation speed control instrument for adjusting the rotation speed of the rotor. According to a further embodiment, a precooler can be arranged before the rotary descaler.

BRIEF DESCRIPTION OF THE DRAWINGS

Other features and advantages of the present invention may be found in the following description of nonrestrictive exemplary embodiments, reference being made to the appended figures in which.

DETAILED DESCRIPTION

Figure 1:
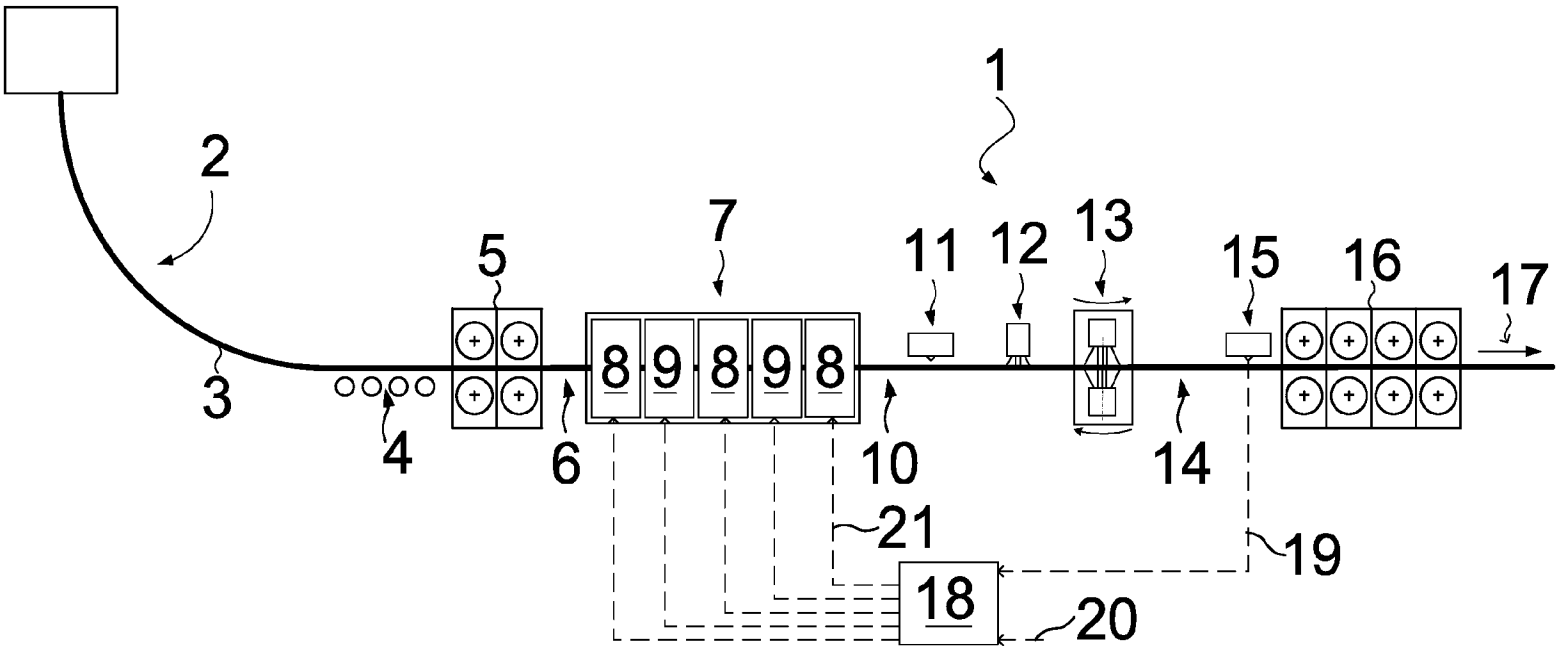
FIG. 1 shows a schematic representation of a combined casting and rolling plant comprising a device for preparing hot-rolling stock

According to an embodiment, in a method of the type mentioned in the introduction, in which the rolling stock is heated in an induction furnace and subsequently descaled, before the rolling stock is rolled in a rolling stand or rolling relay,

- the heated rolling stock is descaled by at least one rotating water jet from a rotor of a rotary descaler; then
- at least one temperature of the descaled rolling stock is respectively recorded by means of a temperature measuring instrument and delivered to a controller; and
- the controller determines at least one control parameter with the aid of a control rule and by taking into account a setpoint temperature, and delivers it to a control component, at least one inductor of the induction furnace being driven so that the temperature of the descaled rolling stock corresponds as far as possible to the setpoint temperature.

In this case, the rolling stock may for example be a thin or thick slab or a finite or endless hot strip (for example from an ESP Endless Strip Production plant, CSP Compact Strip Production plant or similar plants). It is furthermore unimportant whether the rolling in the rolling stand or rolling relay is preliminary, intermediate or final rolling. The heated rolling stock is descaled by at least one rotating water or liquid jet from at least one rotor of the rotary descaler (rotary descalers are known to the person skilled in the art, for which reason reference is made to the Patent Application WO97/27955 A1 in the name of the Applicant for a basic description), so that the rolling stock is cooled only slightly with a high descaling performance. After the descaling, and preferably immediately before the first subsequent rolling process, at least one actual temperature of the rolling stock is recorded by means of the temperature measuring instrument, for example a pyrometer or a thermography camera, and delivered to the controller. The analog or digital controller determines at least one control parameter with the aid of a linear or preferably nonlinear control rule and by taking into account a setpoint temperature, and delivers it to a control component, at least one inductor of the induction furnace being driven so that the temperature of the descaled rolling stock corresponds as far as possible to the setpoint temperature.

The method according to various embodiments ensures that the rolling stock is prepared optimally for a subsequent rolling process, the rolling stock being heated very energy-efficiently and subsequently descaled with the least possible temperature drop and a high descaling performance. The control of the temperature of the rolling stock when entering the first rolling stand, or the rolling relay, furthermore ensures that the rolling stock is at the correct temperature for the subsequent thermomechanical shaping, so that a high quality of the rolling product is ensured.

In an embodiment, not just a single temperature but a temperature profile, i.e. the discrete or continuous temperature distribution as a function of the width direction, of the descaled rolling stock is recorded by means of a temperature profile measuring instrument and delivered to a controller. In this case, the width direction is that direction which lies orthogonally to the transport direction and the thickness direction of the rolling stock. With the aid of a control rule and by taking a setpoint temperature profile into account, the controller determines a plurality of control parameters which are delivered to a plurality of control components, a plurality of inductors of the induction furnace being driven so that the temperature profile of the descaled rolling stock corresponds as far as possible to the setpoint temperature profile. By means of this embodiment, it is possible to influence the temperature profile of the rolling stock very deliberately over the width direction, which in turn has a very advantageous effect on the quality of the resulting rolling stock, particularly in the edge or side regions.

In an expedient embodiment, the rolling stock is heated in the induction furnace by means of at least one inductor with longitudinal field or transverse field heating, the inductor being driven as a function of the control parameter with variable power and optionally variable frequency. Such inductors are known to the person skilled in the art, for example from the textbook Praxishandbuch Thermoprozesstechnik 1: Grundlagen, Verfahren [Practical manual of thermal process technology 1: basics, methods], Carl Kramer and Alfred Mühlbauer, Vulkan Verlag, 2002. In this case, a longitudinal field heating inductor essentially generates a magnetic field $\vec{H}$, or a magnetic flux $\vec{B}$, in the transport direction of the rolling stock; in contrast to this, a transverse field heating inductor essentially generates a magnetic field $\vec{H}$, or a magnetic flux $\vec{B}$, in the thickness direction of the rolling stock. By driving the transverse field heating inductors with variable frequency, it is possible to control the heating of the rolling stock deliberately in the thickness direction. If such an inductor is operated with low frequency, then uniform heating is obtained in the thickness direction; in contrast thereto, during operation with higher frequency only the edge layers of the rolling stock in the thickness direction are deliberately heated. Depending on the specific temperature requirements for the rolling stock, it is possible to carry out the heating of the rolling stock in the induction furnace by means of either exclusively a plurality of inductors with longitudinal field or transverse field heating, or a mixture of inductors with longitudinal field and transverse field heating.

With respect to the heating of rolling stock in the induction furnace, it has been found advantageous to heat rolling stock with a thickness<6 mm preferably by transverse field heating;

rolling stock with a thickness of between 6 mm and 12 mm by at least one inductor each with transverse field and longitudinal field heating; and rolling stock with a thickness>12 mm preferably by longitudinal field heating.

Particularly energy-efficient descaling and a particularly low water consumption of the rotary descaler is possible if the rotating water jet applied to the rolling stock acts on the rolling stock in an interrupted fashion, i.e. a water jet does not act constantly on the rolling stock during a 360° rotation of a rotor of the descaler. As an alternative, it is naturally also possible for the water jet to act constantly on the rolling stock.

It has been found particularly advantageous for the water jets applied to the rolling stock to be generated by at least one rotor having respectively one, preferably from 4 to 12, rotating nozzles, the water delivered to the rotor having a pressure of from 100 to 450 bar, preferably from 250 to 420 bar. This makes it possible to achieve uniform descaling of the rolling stock with relatively low rotation speeds of the rotor, so that the rotor is subjected to low wear. It has furthermore been found particularly advantageous to determine the thickness of a scale layer of the heated rolling stock by means of a scale thickness detector (cf. Patent Specification AT 409464 B in the name of the Applicant, to which reference is made) and, as a function thereof, to adjust either the pressure of the water delivered to the rotor; or the rotational speed of the rotor in a controlled or regulated way. This makes it possible to adapt the descaling performance to the scale thickness actually encountered, so that the energy efficiency of the method according to various embodiments is increased.

A particularly high descaling performance can be achieved if the scale layer of the heated rolling stock is cooled significantly by water jets from a precooler, so that cracks are initiated in the scale layer.

In order to permit the most direct implementation of the method according to various embodiments, it is advantageous

- for the descaler to be configured as a rotary descaler and comprise at least one rotor respectively having at least one rotating nozzle to which water can be applied;
- for a temperature measuring instrument for measuring the temperature of the rolling stock to be arranged before a first rolling stand; and
- for the device to comprise a control instrument for controlling the temperature of the rolling stock, the control instrument being connected to the temperature measuring instrument and at least one inductor of the induction furnace.

With this embodiment, a particularly compact plant can be produced with low procurement costs. It is advantageous for the temperature measuring instrument to be configured as a temperature profile measuring instrument for measuring a plurality of surface temperatures of the rolling stock, it being in communication with at least one control instrument.

For different rolling stock thicknesses, it is advantageous for the induction furnace to comprise either exclusively inductors with longitudinal field or transverse field heating, or at least one inductor each with longitudinal field and transverse field heating.

Particularly simple dismounting of the rotors is possible if the at least one rotor has a vertical rotation axis and can be removed in the horizontal direction from the rotary descaler.

In order to achieve an interrupted water jet for descaling a rolling stock, it is expedient for a rotor respectively to comprise an interrupter for generating an interrupted water jet. Stationary control disks have proven particularly suitable for this.

A particularly low-maintenance design can be achieved if a rotor respectively comprises from 4 to 12 rotating nozzles. By this choice, the circumferential speed of the rotors can be kept small, which leads to particularly low wear of the rotors. With respect to the embodiment of the rotating nozzles, it is advantageous to configure the nozzles either as full-, hollow- or flat-jet nozzles.

For the adaptation of the descaling performance to the actual scaling situation, it is expedient for a scale thickness detector to be arranged downstream of the induction furnace, and to be in communication with either

- a pressure control instrument for adjusting the water applied to the rotor; or
- a rotation speed control instrument for adjusting the rotation speed of the rotor.

It is furthermore advantageous to arrange a precooler before the rotary descaler.

A particularly favorable plant configuration can be achieved if a combined casting and rolling unit, comprising a continuous casting apparatus and optionally a prerolling train, is arranged before the induction furnace. For the discontinuous production of rolling stock, for example for slabs, a gas-fired preheating furnace may be arranged before the induction furnace so that it carries out preheating to a base temperature; the fine adjustment, however, is carried out by a controlled induction furnace.

FIG. 1 shows a combined casting and rolling plant 1 for the continuous production of a hot strip. A steel melt is cast in a continuous casting apparatus 2, so that a continuous strip of a preliminary material 3 is obtained.

It is of course also possible to carry out the method according to various embodiments discontinuously, for example by arranging a gas-fired preheating furnace, which is used to preheat slabs, before the induction furnace (this is not represented in FIG. 1).

The preliminary material is transported uncut by means of a set of rolls 4 to a prerolling train 5, where it is subjected to shaping in the prerolling train comprising two stands. The rolling stock 6 with a thickness of 9 mm subsequently passes through an induction furnace 7, in which it is heated. The induction furnace 7 contains five inductors, the references 8 and 9 respectively denoting an inductor with longitudinal or transverse field heating.

Figure 2:
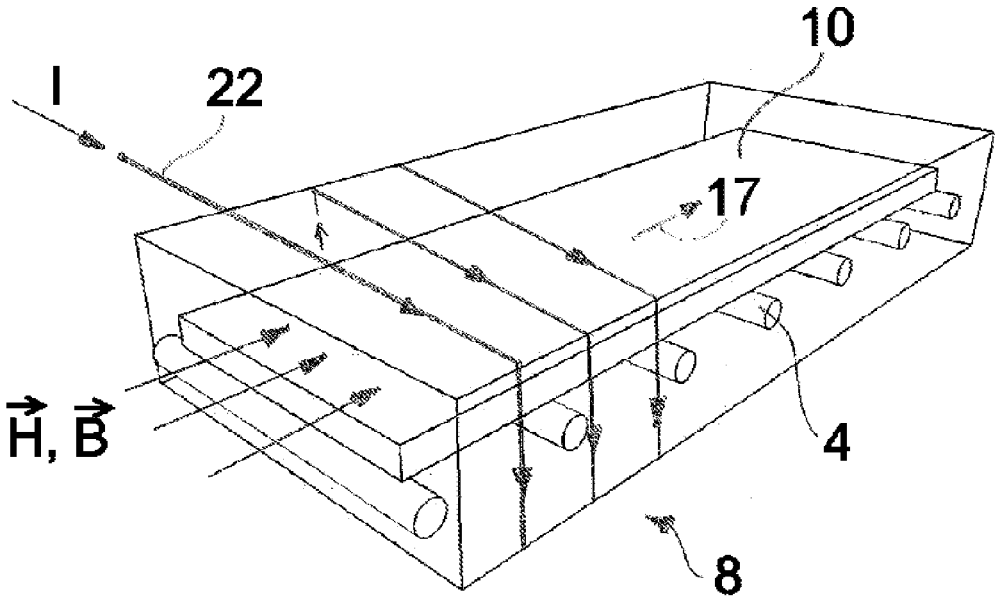
FIG. 2 shows a schematic representation of an induction furnace comprising a longitudinal field heating inductor

The structure of a longitudinal field heating inductor 8 is represented in FIG. 2. Here, a time-variable current I flows through a conductor 22 so that a magnetic field H and a magnetic flux B are initiated essentially in the longitudinal direction of the rolling stock 10. The magnetic field H, or the magnetic flux B, are represented by arrows. The magnetic field induces a voltage in the rolling stock, so that the rolling stock is heated by the resulting eddy currents. As indicated, the conductors 22 surround the rolling stock 10; only 3 turns are represented for the sake of clarity, although the number of turns is greater in reality.

Figure 3:
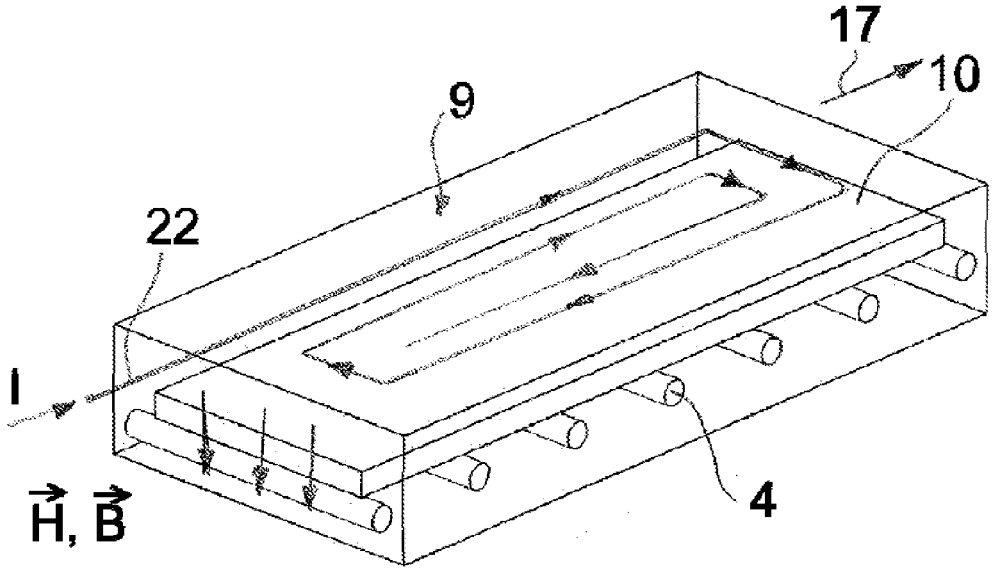
FIG. 3 shows a schematic representation of an induction furnace comprising a transverse field heating inductor

The structure of an induction furnace comprising two transverse field heating inductors 9 is represented in FIG. 3. Here, an inductor is respectively arranged above and below the rolling stock 10, parallel to the surface of the rolling stock. For the sake of clarity, only a few turns on the upper side of the rolling stock are represented. A time-variable current I flows through the inductor consisting of conductors 22, so that a magnetic field H and a magnetic flux B are initiated essentially perpendicularly to the surface of the rolling stock 10. The magnetic field H, or the magnetic flux B, are represented by arrows. The magnetic field induces a voltage in the rolling stock, so that the rolling stock is heated by the resulting eddy currents.

As represented in FIG. 1, the scale layer thickness of the heated rolling stock 10 is determined by means of a scale layer detector 11. The information about the actual scale layer thickness is used to adjust a pressure of the water applied to the rotating nozzles of the rotary descaler. The adjustment of a liquid pressure is known to the person skilled in the art, for which reason only some options will be listed: for example, the rotation speed and therefore the pressure of a high-pressure centrifugal pump may be adjusted, or the rotation speed of a displacement machine, for example a piston pump, is adjusted, a substream of the water being driven through a diaphragm with constant or variable aperture in a circuit to the tank. The heated rolling stock 10 is subsequently subjected to precooling by means of a precooler having a low pressure—compared with the subsequent descaling in a rotary descaler 13—so that cracks are initiated in the scale layer of the rolling stock. The rolling stock is subsequently descaled in a rotary descaler.

Figure 4:
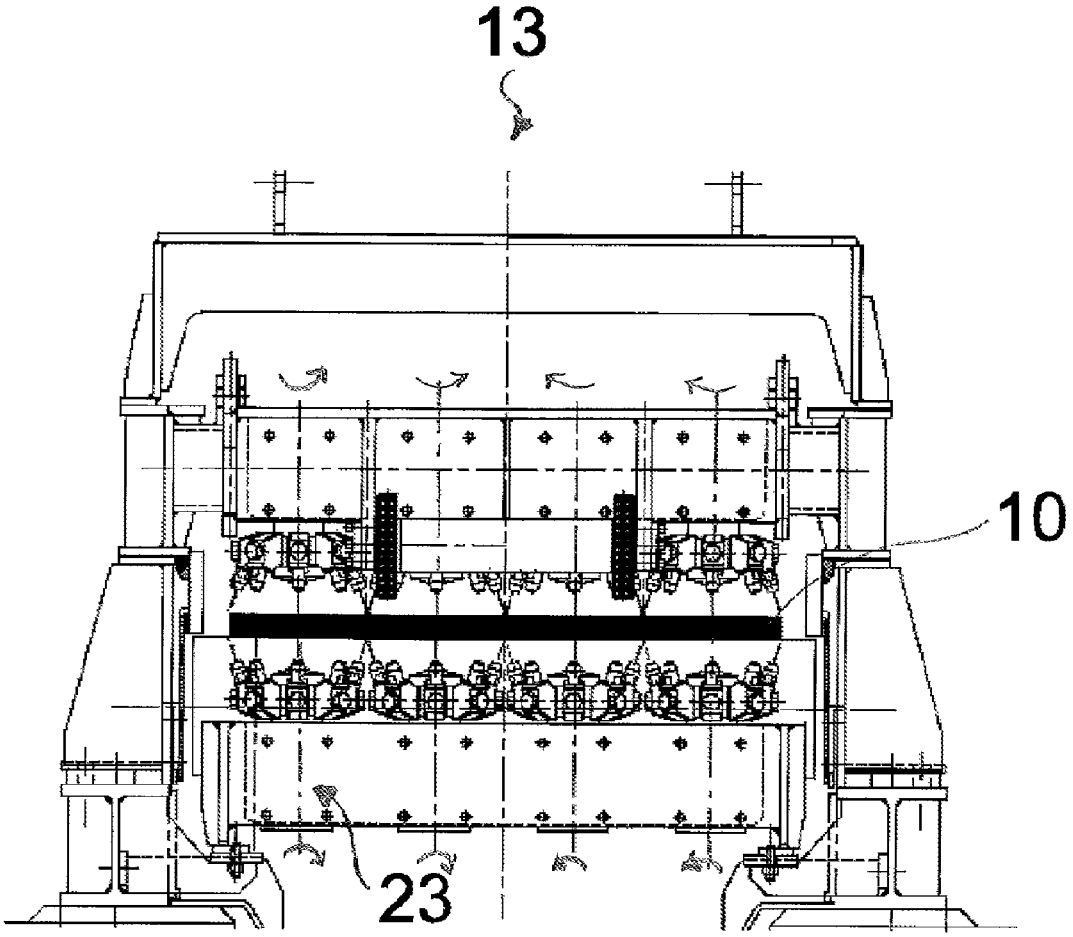
FIG. 4 shows a sketch of a rotary descaler.

Details of the rotary descaler 13 are represented in FIG. 4. The rolling stock 10 is descaled by 8 rotors 23, each having a vertical rotation axis, 4 rotors respectively being arranged on the upper and lower sides of the rolling stock 10. Each rotor respectively carries 8 full-jet nozzles which act intermittently—i.e. not constantly—on the rolling stock 10. The water pressure is adjusted—depending on the scale layer thickness encountered—between 250 and 420 bar. The rotation speed of the rotors is 500 1/min.

FIG. 1 shows further details of various embodiments. After the descaling, the temperature profile of the descaled rolling stock 14 is determined by means of a temperature profile measuring instrument 15, the temperature profile being intended to mean the temperature variation over the width direction of the rolling stock. To this end, the surface temperatures of the 1400 mm wide descaled rolling stock 14 are determined at 100 mm intervals, so that a total of 15 discrete temperature values are obtained. This temperature profile 19 is communicated to a control instrument 18, which determines five control parameters 21 by taking into account a setpoint temperature profile 18 and a nonlinear control rule. The control parameters 21 are used for driving the inductors 8 and 9 of the induction furnace 7, so that the measured temperature profile 19 corresponds as far as possible to the setpoint temperature profile 20.

LIST OF REFERENCES

1 combined casting and rolling plant
2 continuous casting apparatus
3 preliminary material
4 roll train
5 prerolling train
6 rolling stock
7 induction furnace
8 longitudinal field heating inductor
9 transverse field heating inductor
10 heated rolling stock
11 scale thickness detector
12 precooler
13 rotary descaler
14 descaled rolling stock
15 temperature profile measuring instrument
16 final rolling train
17 transport direction
18 control instrument
19 actual temperature profile
20 setpoint temperature profile
21 control parameter
22 electrical conductor
23 rotor

What is claimed is:

1. A method for preparing hot-rolling stock, the method comprising the steps of:

heating a rolling stock in an induction furnace;

descaling the heated rolling stock;

rolling the descaled rolling stock in a rolling stand or a rolling relay, wherein the heated rolling stock is descaled by at least one rotating water jet from a rotor of a rotary descaler;

recording, by a temperature measuring device, at least one temperature of the descaled rolling stock, and delivering the at least one temperature to a controller; and determining, by the controller, at least one control parameter with the aid of a control rule and by taking into account a setpoint temperature, and providing the at least one control parameter to a control component, at least one inductor of the induction furnace being driven so that the temperature of the descaled rolling stock corresponds as far as possible to the setpoint temperature.

2. The method according to claim 1, wherein a temperature profile including the at least one temperature of the descaled rolling stock is recorded by a temperature profile measuring instrument and delivered to the controller, and the controller determines a plurality of control parameters including the at least one control parameter with the aid of the control rule and by taking into account a setpoint temperature profile comprising the setpoint temperature and delivers the plurality of control parameters to a plurality of control components, wherein a plurality of inductors of the induction furnace is driven so that the temperature profile of the descaled rolling stock corresponds as far as possible to the setpoint temperature profile.

3. The method according to claim 1, wherein the heating of rolling stock in the induction furnace is performed by the at least one inductor with at least one of longitudinal field heating and transverse field heating, the at least one inductor being driven as a function of the control parameter with variable power and optionally variable frequency.

4. The method according to claim 3, wherein the heating of the rolling stock in the induction furnace is carried out as follows:

for a rolling stock thickness less than 6 mm by transverse field heating;

for a rolling stock thickness greater than 6 mm and less than 12 mm by at least one inductor, each with transverse field and longitudinal field heating; and for a rolling stock thickness greater than 12 mm by longitudinal field heating.

5. The method according to claim 1, wherein the water jet applied to the rolling stock acts on the rolling stock in an interrupted fashion.

6. The method according to claim 1, wherein the rotor comprises one rotating nozzle, the water delivered to the rotor having a pressure of from 100 to 450 bar.

7. The method according to claim 1, further comprising:

determining a thickness of a scale layer of the heated rolling stock by a scale thickness detector; and as a function of the detected thickness of the scale layer, at least one of delivering the pressure of the water to the rotor, and adjusting the rotational speed of the rotor in a controlled or regulated way.

8. The method according to claim 1, wherein the scale layer of the heated rolling stock is cooled significantly by water jets from a precooler.

9. The method according to claim 1, wherein the water jet is generated by the rotor comprising from 4 to 12 rotating nozzles, the water delivered to the rotor having a pressure of from 100 to 450 bar.

10. The method according to claim 9, wherein the water delivered to the rotor having a pressure of from 250 to 420 bar.

11. The method according to claim 6, wherein the water delivered to the rotor having a pressure of from 250 to 420 bar.

12. A device for preparing hot-rolling stock before shaping in at least one rolling stand or rolling relay, the device comprising:

an induction furnace comprising at least one inductor, a descaler and at least one rolling stand, wherein the descaler is configured as a rotary descaler and comprises at least one rotor including at least one rotating nozzle configured to receive water;

a temperature measuring instrument for measuring a temperature of the rolling stock, the temperature measurement instrument positioned before the at least one rolling stand or rolling relay; and a control instrument for controlling the temperature of the rolling stock, the control instrument being connected to the temperature measuring instrument and the at least one inductor of the induction furnace, wherein the control instrument determines at least one control parameter with the aid of a control rule and taking into account a setpoint temperature, and provides the at least one control parameter to a control component, and wherein the at least one inductor of the induction furnace is driven so that the temperature of the descaled rolling stock corresponds to the setpoint temperature.

13. The device according to claim 12, wherein the temperature measuring instrument is configured as a temperature profile measuring instrument configured to measure discrete or continuous temperature distribution as a function of a width direction of the descaled rolling stock, and wherein the temperature measuring instrument is in communication with the control instrument.

14. The device according to claim 12, wherein the induction furnace comprises either exclusively inductors with longitudinal field heating or transverse field heating, or the at least one inductor each with both longitudinal field heating and transverse field heating.

15. The device according to claim 12, wherein the at least one rotor has a vertical rotation axis, and is removable in the horizontal direction from the rotary descaler.

16. The device according to claim 12, wherein the at least one rotor contains an interrupter for generating an interrupted water jet.

17. The device according to claim 12, wherein the at least one rotor comprises from 4 to 12 rotating nozzles.

18. The device according to claim 12, further comprising:

a scale thickness detector arranged downstream of the induction furnace, wherein the scale thickness detector is in communication with at least one of a pressure control instrument for adjusting the water applied to the rotor, and a rotation speed control instrument for adjusting the rotation speed of the rotor.

19. The device according to claim 12, wherein a precooler is arranged before the rotary descaler.

* * * * *